US005145318A

United States Patent [19]

Olson

[11] Patent Number: 5,145,318

[45] Date of Patent: Sep. 8, 1992

[54] FLANGE-MOUNTED CONTROLLABLE PITCH MARINE PROPELLER

[75] Inventor: Stephen C. Olson, Norfolk, Mass.

[73] Assignee: Bird-Johnson Company, Walpole, Mass.

[21] Appl. No.: 769,575

[22] Filed: Oct. 2, 1991

Related U.S. Application Data

[63] Continuation of Ser. No. 437,935, Nov. 16, 1989, abandoned.

[51] Int. Cl.[5] ..... B63H 3/04; B63H 23/34

[52] U.S. Cl. ..... 416/167; 416/213 A; 416/244 B; 416/164

[58] Field of Search ..... 416/146 A, 146 B, 147, 416/157 R, 163, 164, 167, 213 A, 244 R, 244 B, 245 R, 245 A; 440/49, 50

[56] References Cited

U.S. PATENT DOCUMENTS

| | | | |
|---|---|---|---|
| 2,200,952 | 5/1940 | Farrell | 416/213 A |
| 2,360,982 | 10/1944 | Sahle | 416/166 X |
| 2,514,097 | 7/1950 | Sharp | 440/50 X |
| 2,523,053 | 9/1950 | Obrist | 416/157 R |
| 2,913,057 | 11/1959 | Willi | 416/157 |
| 3,501,251 | 3/1970 | Haglund et al. | 416/157 R |
| 3,802,800 | 4/1974 | Merks et al. | 416/157 R |
| 4,810,166 | 3/1989 | Sawizky et al. | 416/167 |

FOREIGN PATENT DOCUMENTS 3301621 7/1984 Fed. Rep. of Germany ... 416/157 R

OTHER PUBLICATIONS

Renou DardeL brochure on Controllable Pitch Propellers.

KaMeWa/Seffle brochure entitled "Controllable Pitch Propellers & Valmet Reduction Gear Boxes".

*Primary Examiner*—Edward K. Look
*Assistant Examiner*—James A. Larson
*Attorney, Agent, or Firm*—Brumbaugh, Graves, Donohue & Raymond

[57] ABSTRACT

A controllable pitch marine propeller includes a hub body having a forward section provided with holes for bolts and locating and torque pins and a frontal surface that mates with a hub flange and an internal flange that defines an annular cavity and receives a cup-shaped cross-head. A hub flange and propeller shaft assembly comprises separate hub flange and shaft members joined by at least one weldment formed in a tapered weld cavity and protected by a liner shrink-fitted on the perimeter of the hub flange and a removable plate sealed to the hub liner and the shaft liner.

15 Claims, 3 Drawing Sheets

FLANGE-MOUNTED CONTROLLABLE PITCH MARINE PROPELLER

This application is a continuation of application Ser. No. 07/437,935, filed on Nov. 16, 1989, abandoned.

BACKGROUND OF THE INVENTION

Controllable pitch marine propellers provide numerous advantages over fixed pitch propellers, especially in vessels that operate at various speeds with varying loads. A well-known form of controllable pitch propeller is the force rod type, in which a blade pitch control mechanism in the propeller hub is operated by a force rod that extends through the shaft and is moved forward and aftward by an inboard hydraulic servo or other suitable means. The pitch-control mechanism in the hub comprises a cross-head affixed to the aft end of the force rod and coupled to each of the blades by crank pins and slideways. In some designs the slideways are on the cross-head and the pins on the blade mounts. In other designs the pins are on the cross-head and work in corresponding slideways on the blade mounts. The blades are, of course, mounted on the hub for rotation about pivot axes disposed radially of the propeller shaft axis, and the crank pins and slideways are offset generally circumferentially from the pivot axes of the blades.

In the majority of present designs of force rod type controllable pitch propellers, the cross-head is generally a block of metal attached to the end of the force rod and containing slideways for each crank pin sliding shoe. It is located within the propeller hub such that at a neutral (zero pitch) position it lies radially inwardly of the blade-mounting trunions. Upon movements for ahead and astern pitch control the cross-head moves forward and aftward from the neutral position. With this configuration, the open region of the hub swept by the cross-head in its pitch-controlling motions has to be aftward of the aft end of the shaft. Accordingly, the shafting and aftmost shaft bearing have to be designed to carry a substantial overhung moment due to the load of the propeller, which is located almost entirely aftward of the aft end of the shaft.

There are two principal ways of attaching a propeller to a tailshaft. One is to provide an externally tapered end on the shaft and a matching internally tapered mount spigot in the propeller hub. The hub is driven tightly onto the taper and fastened by a large nut. The other involves forging a flange onto the shaft end and bolting the hub to the flange. The flange mount is significantly more expensive than the taper mount and is, therefore, rarely used in smaller propellers, say those less than 12 feet in diameter and 3000 H.P.

It is known to weld coupling flanges onto sections of a propeller shaft that are located inboard of the vessel hull. Welded flanges inboard of the hull are loaded primarily in torsion and only lightly loaded in flexure, because the shaft itself is relatively light in weight and is supported by bearings. Accordingly, the strength requirements for the weldments between the shaft and coupling flange are not great. Also, the inboard weldments are not immersed in water, and corrosion is not a problem.

A flange-mounted propeller presents a very different situation. First, the flange has to carry the very high, cyclical flexural loads resulting from the overhang moment of the propeller, as well as high torsional loads. Second, the flange is immersed in water. Because of the high loads and the exposure to corrosion, welded propeller mount flanges have not been used heretofore.

SUMMARY OF THE INVENTION

One object of the present invention is to provide a controllable pitch propeller ("CPP") that is constructed such that it can easily be modified for either a tapered mount or a flange mount. Most of the parts are interchangeable, which provides significant economies in production and repair. Another object is to provide highly stable support and guidance for the cross-head of a force rod-type CPP. Still a further object is to provide an economical flange mount for a propeller, which mount is useful not only for CPP's but fixed blade propellers as well.

In accordance with one aspect of the present invention there is provided a CPP comprising a controllable pitch marine propeller having a hub body carrying a plurality of propeller blades for rotation about pivot axes disposed radially of the hub axis and adapted to be mounted on the tail end of a tubular propeller shaft, a force rod received within the shaft for movement forward and aftward and extending into the hub body, and a cross-head affixed to the force rod and coupled to each blade by a crank pin and slideway, whereby the blades are rotatable about their pivot axes to alter the blade pitch upon movement of the force rod and cross-head. The present invention, in one aspect, is characterized in that the hub body has a forward section having a forward face adapted to be mated with a propeller shaft flange, threaded holes for bolts inserted through the flange, plain holes for locating pins that also carry propulsion torque and a tubular mounting spigot extending aftward and defining an annular slot with an outer flange portion, in that the cross-head is generally cup-shaped, having a base portion affixed to the force rod aftwardly of the spigot and a tubular flange portion extending forwardly from the base portion into the annular slot and surrounding the spigot in telescoping relation, in that the cross-head flange portion has internal surfaces supported in plain bearing relation for forward-aftward movements of the cross-head by external surfaces of the spigot, and in that the cross-head has external surfaces supported in plain bearing relationship by internal surfaces of the hub body located aftward of the aft end of the spigot.

In accordance with another aspect of the invention, a hub flange and propeller shaft assembly is provided that is significantly less expensive than the conventional forged flange-type marine propeller mounts, thereby providing an economical alternative to a taper-type propeller mount or a propeller shaft with a forged flange. A hub flange and propeller shaft assembly for a marine propeller, according to the invention, comprises a propeller shaft and a flange member characterized in that the propeller shaft and flange member are separate and are joined by a weldment, which weldment is at least one body of weld metal formed in a cavity defined by surfaces of the shaft and flange member that face each other to define a cavity that is divergent toward the external surface of the weldment. To avoid stress concentrations at the juncture of the shaft and flange member, either the shaft or the flange member has a fillet. It is important to avoid weakening the weldment between the shaft and the flange member, and, therefore, the holes in the flange for the bolts and locating and torque pins do not transect the weldment.

According to still another aspect of the present invention, there is provided a marine propeller mount assembly having a propeller hub body that includes a forward face, threaded holes opening at the forward face to receive bolts and plain holes opening at the face to receive locating and torque pins, a propeller shaft having a protective liner of a corrosion resistant material and a hub flange affixed to the shaft and mounting the propeller hub body on the shaft by bolts passing through the flange member into the threaded holes and locating and torque pins received in it and in the plain holes. The invention is characterized in that the hub flange is a member separate from the propeller shaft, in that the hub flange is joined to the tailshaft by welding, in that the outer perimeter of the hub flange has a shrink-fitted protective sleeve of a corrosion resistant material, and in that a protective plate of a corrosion-resistant material is removably fastened to the forward face of the hub flange in sealed relation to the liner of the propeller shaft and to the protective sleeve.

For a better understanding of the invention, reference may be made to the following description of employing embodiments, taken in conjunction with the accompanying drawings.

DESCRIPTION OF THE EMBODIMENTS

Figure 1:
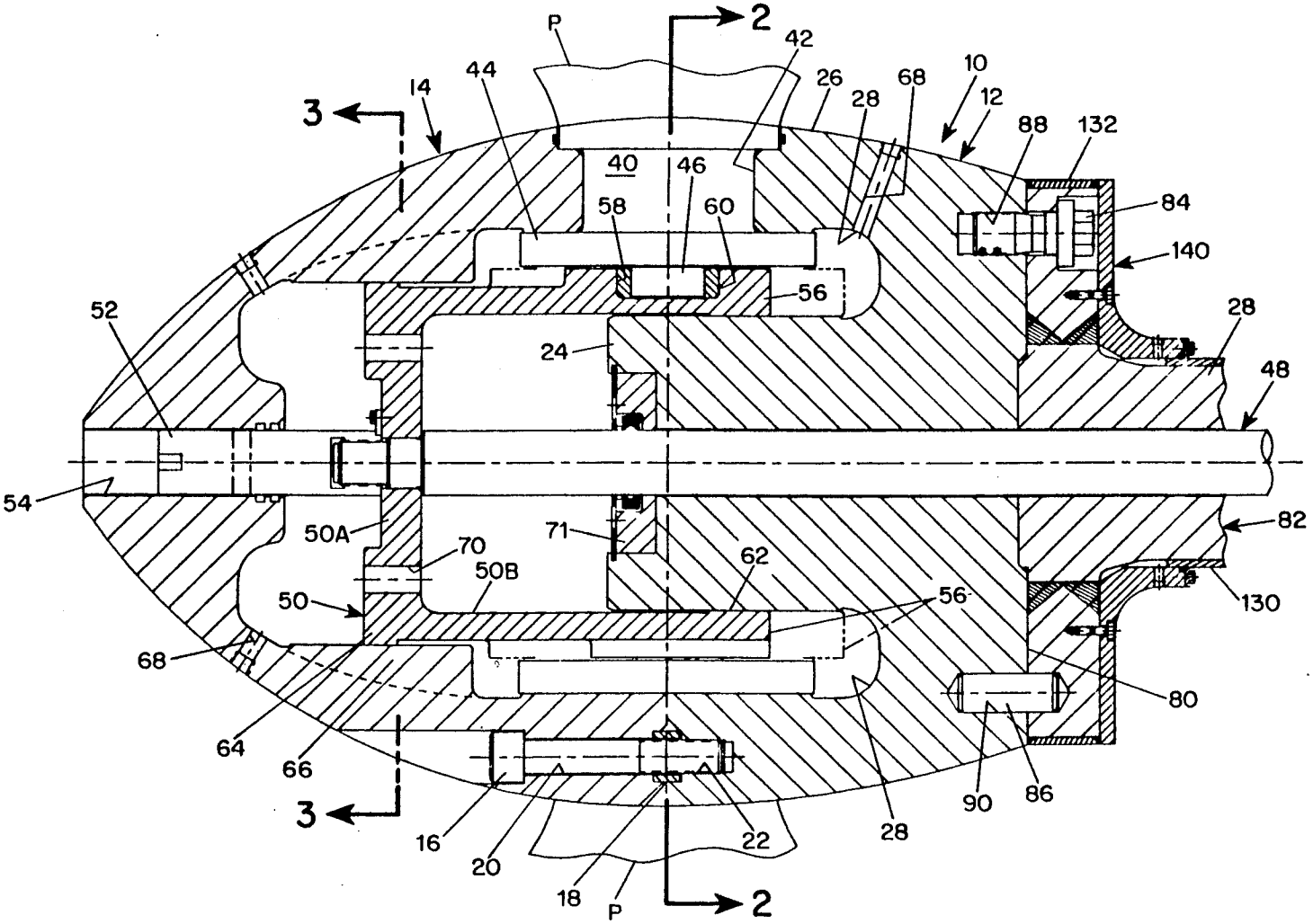
FIG. 1 is a side cross-sectional view of an embodiment of the CPP taken along a broken plane, which is represented generally by the lines 1—1 of FIG. 2.
Figure 2:
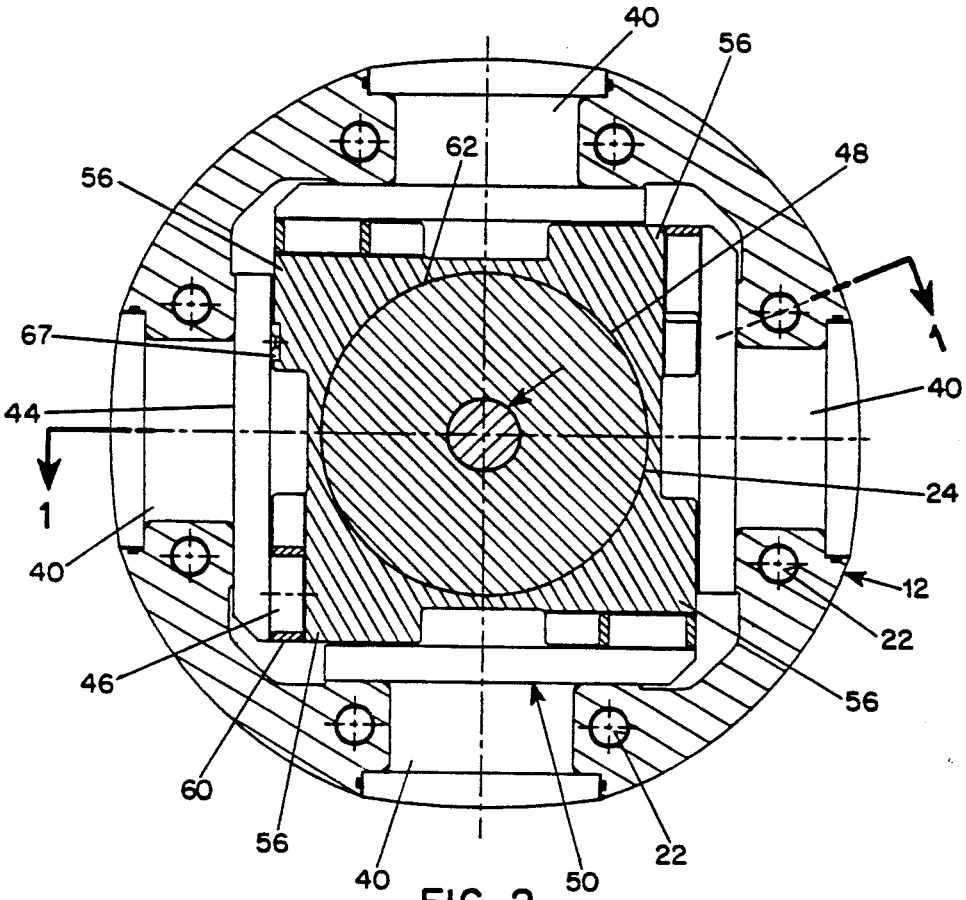
FIGS. 2 and 3 are end cross-sectional views of the CPP taken along the lines 2—2 and 3—3, respectively, of FIG. 1.
Figure 3:
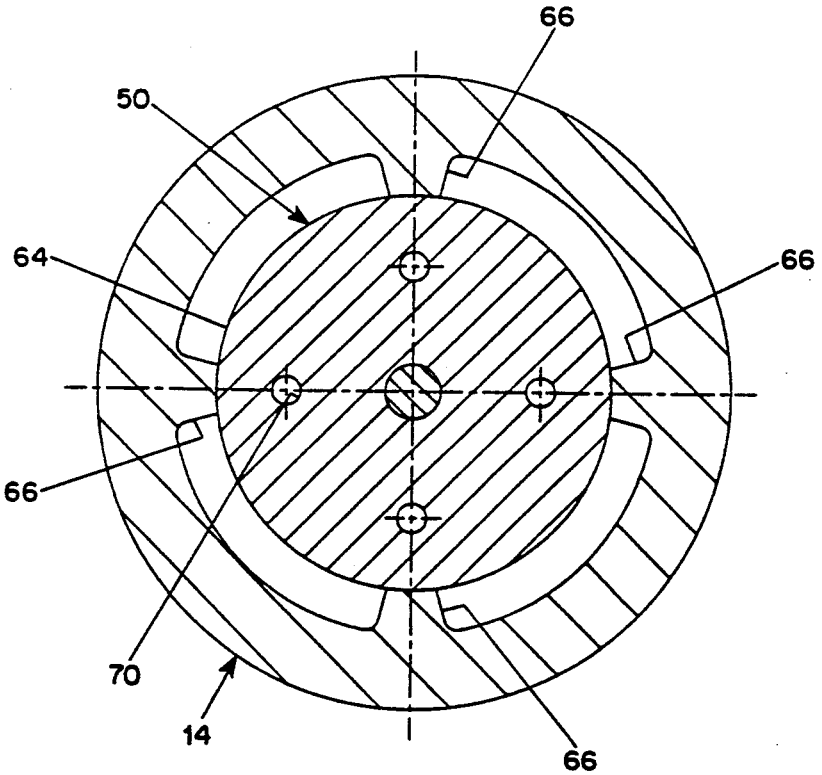

The CPP of FIGS. 1 to 3 is almost exactly the same as the CPP described and shown in U.S. Pat. No. 4,810,166 (Sawizky et al., Mar. 7, 1989), which is owned by the assignee of the present invention. U.S. Pat. No. 4,810,166 is incorporated by reference into the present specification. The only component of the CPP of FIGS. 1 to 3 that differs from the CPP of the Sawizky et al. patent is the forward section 12 of the hub, as hereinafter is described.

The embodiment of the CPP (FIGS. 1 to 3) comprises a two-piece hub body 10 consisting of a forward section 12 and an aftward section 14 that meet along a plane defined by the pivot axes of the blades, which is coincident with the section line 2—2 of FIG. 1. The hub sections are joined by bolts 16, and assembly and exact register of the sections are facilitated by hollow dowels 18 partly received in the bolt holes 20 and 22. The external surface of the hub is suitably streamlined for minimum drag.

The forward section 12 of the hub body has an internal tubular mounting spigot 24 that extends aftward to a terminus that is to the aft of the plane of the blade pivot axes. The external surface of the spigot 24 defines with the internal surface of an outer flange portion 26 of the forward section 12 an annular cavity 28 that extends forwardly to a location within the hub well forward of the plane of the blade pivot axes.

The blades P of the propeller (only the root portions are shown in the drawings) extend out from trunions 40 received for rotation in mounting sockets 42 in the hub body and retained radially in place by crank ring portions 44 received within the internal annular cavity 28 of the hub body section 12. A crank pin 46 projects inwardly into the hub cavity from the crank ring of each blade. In the embodiment the blade, trunion and crank ring are integral (unitary), but they could well be separate elements assembled with bolts. In the neutral (zero pitch) settings of the blades, the crank pins are offset circumferentially from the blade pivot axes and are centered substantially on the plane of the pivot axes—this position is shown in the drawings.

A force rod 48 extends through a tubular propeller shaft (only the tailshaft 100 is shown), from an inboard hydraulic servo (not shown) or other suitable drive device for moving the force rod forward and aftward. A cross-head 50 is fastened to the force rod 48 by a special long nut 52, which not only fastens the cross-head to the force rod but also provides volume compensation for the force rod 48 and is received in a hole 54 in the aftward section 14 of the hub body. The cross-head is generally cup-shaped, in that it includes a round disc-like base portion 50A and a tubular flange portion 50B extending forward from the perimeter of the base portion into the annular cavity 28. The tubular flange portion 50B transforms from a circular to a square shape on its outside such as to form protecting boss portions 56 on the forward end (see FIGS. 2 and 3).

At the location of each of the crank pins 46, each boss portion 56 has a slideway 58 oriented transversely of the shaft axis, and each slideway receives a sliding shoe 60 that, in turn, accepts a corresponding crank pin. When the force rod and cross-head are pulled forward from the neutral position, the blades are rotated counter-clockwise, which is the preferred mode to adjust the blades to deliver astern thrust. (The design can be readily modified to produce the opposite effect, i.e., aft movement of the force rod causing counter-clockwise blade rotation to deliver astern thrust.) Conversely, when the force rod is pushed aftward, the blades are pivoted to deliver ahead thrust. The servo is suitably controlled to provide infinite settings between maximum pitches for astern and ahead thrusts. The maximum cross-head travel forward into the recess 28 is indicated in partial phantom outlines of the boss portions 56 in FIG. 1.

The cross-head 50 is fastened by the nut 52 to the force rod 48 for axial movement and is supported in the hub body by surfaces providing plain bearings. A circular cylindrical internal surface 62 along the forward part of the flange portion 50B of the cross-head rides in plain bearing relation on the outer circular cylindrical surface of the tubular mounting spigot 24, and external surfaces 64 of the aftward part of the cross-head ride on ribs 66 on the aftward hub section 14. The force rod 48 and cross-head 50 are not rotationally affixed to the hub or shafting, but the hub imparts rotation to them through engagement of a bearing pad 67 (see FIG. 2) on one of the boss portions 56 by a crank ring portion 44 of one of the blades.

The hub cavity is suitably sealed, as shown, and is filled with grease through capped grease holes 68. The base portion 50A of the cross-head has holes 70 through it to allow the movement of the cross-head through the grease. The grease can also readily displace through the openings between the ribs 66 (see FIG. 3) and the open spaces between the cross-head flange portion 50B and the hub cavity walls (see FIG. 2). A closure 71 is sealed to the force rod 48 at the aft end of the flange 24. The nut 52 is of a uniform cross-sectional area along its length, which area is equal to that of the force rod. Therefore, the volume of the grease-filled cavity of the hub does not change as the tail of the force rod moves in and out of the cavity, because the nut displaces the same volume as the force rod for corresponding intrusions into the grease.

The forward end face 80 of the hub body forward section 12 mates with a hub flange and tailshaft assembly 82 and is fastened to it by bolts 84 and thrust and locating pins 86 received in threaded holes 88 and plain holes 90 in the hub body forward section 12.

Figure 4:
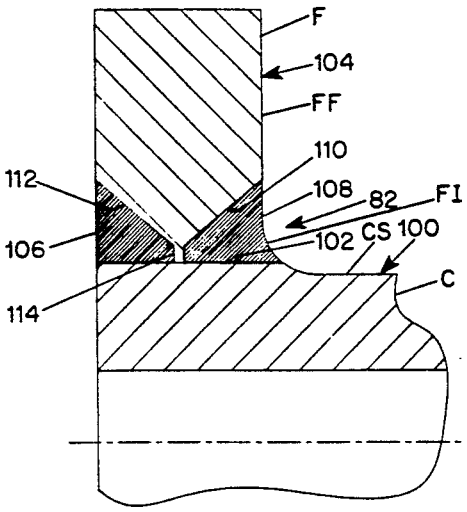
FIG. 4 is a half axial cross-sectional view of one embodiment of a hub flange and propeller shaft assembly.
Figure 5:
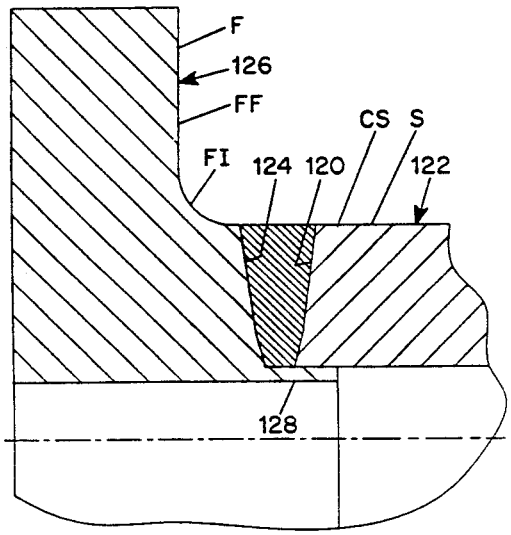
FIG. 5 is a half axial cross-sectional view of another embodiment of a hub flange and propeller shaft assembly.

The assembly 82 consists, structurally, of a shaft member and a flange member joined by a weldment, two exemplary embodiments of which are described below and are shown in FIG. 4 and 5, and constitutes a tubular propeller shaft that is composed, geometrically, of a shaft portion S and a flange portion F at the aft end of the shaft portion. The shaft portion has a circular cylindrical surface CS adjacent the flange portion, the flange portion has a front face FF, and there is a fillet FI at the juncture between the front face of the flange portion and the cylindrical surface of the shaft portion.

In one embodiment of a hub flange and shaft assembly 82, as shown in FIG. 4, the propeller shaft or tailshaft 100 of the ship's shafting (the terms propeller shaft and tailshaft are both used, generally interchangeably, to refer to the aft-most section of the ship's shafting to which the propeller is attached) has an external circular cylindrical surface 102. An annular hub flange member 104 is joined to the tailshaft 100 outwardly of the surface 102 by weldments 106 and 108. The flange member 104 has two surfaces 110 and 112 that diverge radially outwardly, one forwardly and one aftwardly, to define with the surface 102 of the tailshaft tapered, annular cavities for the weld metal that diverge toward the external surfaces of the weldments. An internal rib 114 extends inwardly from the radially inner margins of the surfaces 110 and 112 and abuts the cylindrical surface 102 of the tailshaft to provide root areas of parent metal for the weldments 106 and 108.

A second embodiment of a hub flange and tailshaft assembly, as shown in FIG. 5 comprises a tapered weld cavity defined by an aft terminal surface 120 on a tailshaft 122 and surface 124 on a hub flange member 126. A central, forwardly extending annular flange portion 128 of the hub flange member 126 is received telescopically within the bore of the tailshaft 122 to provide parent metal for the root weld of the weldment. The flange 128 is removed when the hub and tailshaft assembly is machined after welding.

An example of the weld procedure for the assemblies of FIGS. 4 and 5 is as follows:

Hub flange material: ASTM-515, Grade 60

Shaft Material: Round bar, 1020 Carbon Steel Pipe, ASTM A53, Grade B Forged Stock, or ASTM A668-83, Class B Qualified Welding Range: 3/16" to unlimited thickness Filler Material (G.M.A.W.): A. W. S. Specification Number A5.18-79; A.W.S. Class Number ER 70S-2; Trade Name, Linde 65; Diameter 0.062 in.

Filler Material (S.M.A.W.): A.W.S. Specification Number A5.1-81; A.W.S. Class Number E7018; Trade Name, Lincoln LH78; Diameter 5/32 in.

The root pass is made using the Shielded Metal Arc Welding Process (S.M.A.C.) with direct current, reverse polarity, at a current of 130 to 150 amps supplied by a constant current power supply (e.g., Miller 330AB/BP). The remainder of the weldments are made using the Gas Metal Arc Welding Process (G.M.A.C.) with direct current, reverse polarity, at a voltage of 29 to 31 volts and current of 250 to 290 amps supplied by a constant voltage power supply (e.g., Miller MP-45E). The welds are made with the tailshaft positioned horizontally on variable speed rollers driven at a speed adjusted to provide a travel speed of 14 to 20 inches per minute. The shielding gas for the G.M.A.C. welds is 98% argon, 2% oxygen supplied at 40 to 50 cu. ft./hr. The work is preheated with an oxy-acetylene or propane torch with a neutral flame to a minimum preheat temperature of 250° F. The interpass temperature is maintained in the range of 250° to 500° F. The welded assembly is heat treated at 1150° F. for 4 hours (1 hour per inch of thickness) with a maximum rate of change in both heating and cooling of 100° F. per hour.

Figure 6:
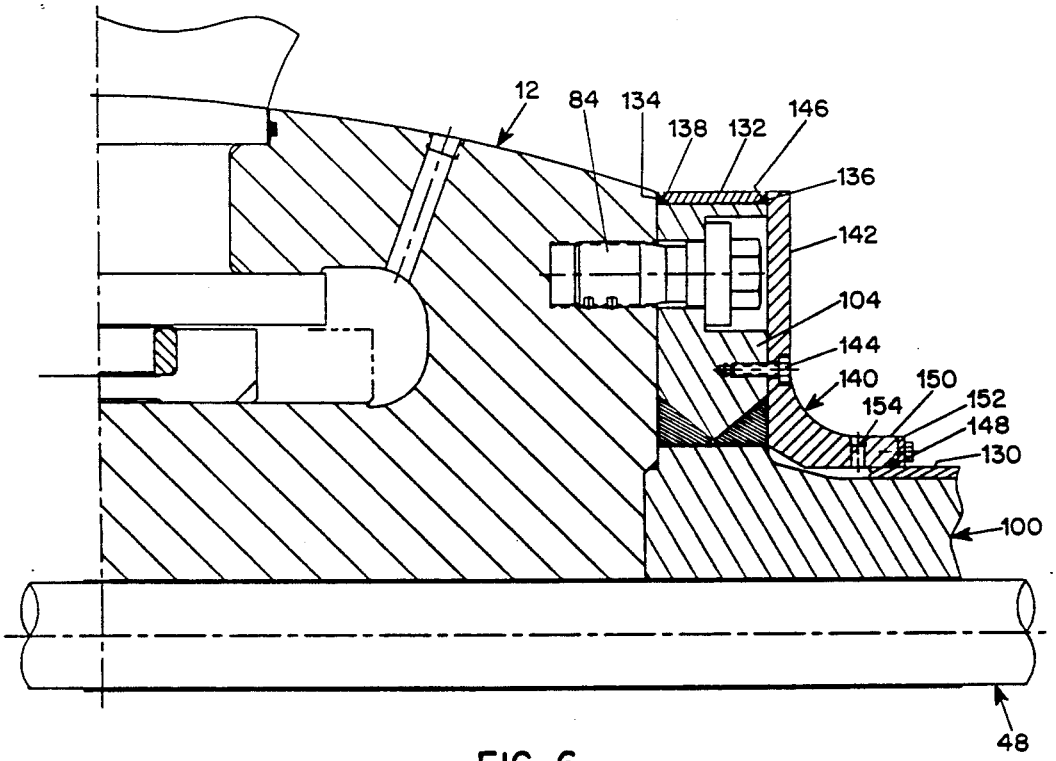
FIG. 6 is a partial side cross-sectional view of the forward end of the hub flange on a larger scale than that of FIG. 1.

As is conventional, the tailshaft (100 or 122) has a liner 130 (See FIG. 1), which is either in situ welded stainless steel or a shrink-fitted bronze sleeve. To protect the hub flange member (e.g., 104, FIGS. 1 and 4) a bronze sleeve 132 is shrink-fitted onto the outer circumference of the flange member. Each end of the sleeve 132 is chamfered internally to provide an undercut 134, 136 (see FIG. 6). When the propeller is installed on the hub shaft, an O-ring seal 138 is installed in the undercut 134. A protector plate 140, which was previously placed on the tailshaft 100 (or 122), is slided aftward to bring its annular flat base portion 142 to bear against the forward face of the hub flange 104 and is fastened to the hub flange by screws 144. An O-ring seal 146 installed in the undercut 136 of the sleeve 132 seals the plate 140 to the sleeve. An O-ring seal 148 is installed between the circular cylindrical, forwardly extending flange portion 150 of the plate 140 and the tailshaft liner 130 and is held in place by a retainer ring 152. Grease or some other suitable filler material is pumped into the space between the protective plate 140 and the tailshaft through plugged fill holes 154 in the protective plate.

I claim:

1. A propeller shaft and hub flange assembly for a marine propeller, the assembly including a hub flange portion having a forward face and a shaft portion having an external circular cylindrical surface adjacent the hub flange portion, characterized in that a tubular shaft member and a flange member are separate and are joined by at least one weldment, which weldment is a body of weld metal formed in a cavity defined by surfaces of the shaft member and flange member that face each other such that the cavity enlarges toward the external surface of the weldment, in that the assembly has a fillet between the forward face of the flange portion and the external surface of the shaft portion and in that the propeller shaft and hub flange assembly is adapted to be joined to a marine propeller solely by bolts and locating and torque pins received in holes in the flange member that do not transect the weldment.

2. An assembly according to claim 1 and further characterized in that the aft end of the shaft member has an enlarged portion adjacent its aft end, in that the flange member surrounds the enlarged portion of the shaft member and has two internal surfaces, both diverging outwardly with respect to the axis of the shaft assembly, one forwardly and the other aftwardly, and defining with the enlarged portion of the shaft member tapered cavities, and in that bodies of weld metal fill the respective cavities.

3. An assembly according to claim 2 and further characterized in that an internal rib of the flange member forms junctures with the innermost extremities of the two internal surfaces and abuts the enlarged portion of the shaft member such as to provide parent material for root passes of the weldments in the respective cavities.

4. An assembly according to claim 1 and further characterized in that the aft end of the shaft member has an aftward terminal surface having a forward and radially outward taper, in that the flange member has a forwardly extending boss portion having a forwardly facing surface that has an aftward and radially outward taper and that registers axially with the terminal surface of the shaft member to define an annular cavity, and in that the weldment is a body of weld metal received in the cavity.

5. An assembly according to claim 4 and further characterized in that the flange member has a forwardly extending flange portion forming a juncture with the forwardly facing surface and received telescopically within the aft end of a bore of the shaft member such as to provide parent material for a root pass of the weldment in the cavity, and which flange portion is to be removed when the assembly is machined.

6. An assembly according to claim 1 wherein the weldment comprises a root pass made using the Shielded Metal Arc Welding Process and the remainder of the weldment is made using the Gas Metal Arc Welding Process.

7. A marine propeller mount assembly having a propeller hub body having a forward face, threaded holes opening at the forward face of the hub body to receive bolts and plain holes opening at the forward face of the hub body to receive torque and locating pins, a propeller shaft having a shaft portion having a protective liner of a corrosion resistant material and a hub flange portion affixed to the propeller hub body by bolts passing through the hub flange portion into the threaded holes and locating and torque pins received in the hub flange portion and in the plain holes, characterized in that the propeller shaft is an assembly including a shift member and flange member separate from the shaft member, in that the flange member is joined to the shaft member by weldments, in that the outer perimeter of the flange member has a shrink-fitted protective liner of a corrosion resistant material, and in that a protective plate of a corrosion-resistant material is removably fastened to the forward face of the flange member in sealed relation to the liner of the shaft portion and the protective liner of the flange member.

8. An assembly according to claim 7 wherein the protective plate includes an annular plate portion abutting the forward face of the flange member and a circular cylindrical flange portion defining a bore that receives telescopically an aft end part of the shaft portion and the protective liner of the shaft portion, and wherein an O-ring seal is received between the bore of the flange portion of the protective plate and the protective liner of the shaft portion.

9. An assembly according to claim 8 wherein the hub flange protective liner has an undercut at each edge, and further comprising a second O-ring seal received in the undercut adjacent the propeller hub body and a third O-ring seal received in the undercut adjacent the plate portion of the protective plate.

10. A controllable pitch marine propeller having a hub body carrying a plurality of propeller blades for rotation about pivot axes disposed radially of the hub axis and adapted to be mounted on the aft end of a tubular propeller shaft having a shaft portion and a hub flange portion at the aft end of the shaft portion, a force rod received through the propeller shaft for movement forward and aftward and extending into the hub body, and a cross-head affixed to the force rod and coupled to each blade by a crank pin and slideway, whereby the blades are rotatable about their pivot axes to alter the blade pitch upon movement of the force rod and cross-head, characterized in that the hub body has a forward section having a forward face adapted to be mated with the flange portion of the propeller shaft, threaded holes for bolts inserted through the flange portion, plain holes for torque and locating pins, and a tubular mounting spigot extending aftward and defining with an outer flange portion of the forward section an annular cavity, in that the cross-head is generally cup-shaped, having a base portion affixed to the force rod aftwardly of the spigot and a tubular flange portion extending forwardly from the base portion into the annular cavity and surrounding the spigot in telescoping relation, in that the cross-head flange portion has internal surfaces supported in plain bearing relation for forward-aftward movements of the cross-head by external surfaces of the spigot, in that the cross-head has external surfaces supported in plain bearing relation by internal surfaces of the hub body located aftward of the aft end of the spigot, in that the shaft portion of the propeller shaft has a circular cylindrical external surface adjacent the flange portion and the flange portion has a front face, in that the propeller shaft is an assembly having a flange member and a shaft member, in that a weldment joins the flange member to the shaft member, in that the propeller shaft has a fillet between the front face of the flange portion and the external surface of the shaft portion, in that the forward section of the hub body is attached to the flange member solely by bolts and locating and torque pins, and in that the bolts and torque pins do not transact the weldment.

11. A controllable pitch marine propeller according to claim 10 and further characterized in that the aft end portion of the shaft member has an enlarged portion adjacent its aft end, in that the flange member is annular and surrounds the enlarged portion of the shaft member and has two internal surfaces, both diverging outwardly relative to the axis of the propeller shaft, one forwardly and the other aftwardly, that define with the enlarged portion of the shaft member tapered cavities, and in that the weldment consists of bodies of weld metal filling the tapered cavities.

12. A controllable pitch marine propeller according to claim 11 and further characterized in that an internal rib of the flange member forms junctures with the innermost extremities of the two internal surfaces and abuts the enlarged portion of the shaft member such as to provide parent material for root passes of the weldments in the respective cavities.

13. A controllable pitch marine propeller according to claim 10 and further characterized in that the aft end of the shaft member has an aftward terminal surface that has a forward and radially outward taper, in that the flange member has a forwardly extending boss portion having a forwardly facing surface that has an aftward and radially outward taper and that registers axially with the terminal surface of the shaft member to define an annular cavity, and in that the weldment is a body of weld metal received in the cavity.

14. A controllable pitch marine propeller according to claim 13 and further characterized in that the flange member has a forwardly extending flange portion forming a juncture with the terminal surface and received telescopically within the aft end of a bore of the shaft member such as to provide parent material for a root pass of the weldment in the cavity, and which flange portion is to be removed when the propeller shaft is machined.

15. A controllable pitch marine propeller according to claim 10 wherein the weldment comprises a root pass made using the Shielded Metal Arc Welding Process and the remainder of the weldment is made using the Gas Metal Arc Welding Process.

* * * * *